US009606489B2

(12) United States Patent
Takaya et al.

(10) Patent No.: US 9,606,489 B2
(45) Date of Patent: Mar. 28, 2017

(54) IMAGE FORMING APPARATUS, IMAGE FORMING SYSTEM, AND DENSITY UNEVENNESS CORRECTION METHOD

(71) Applicant: KONICA MINOLTA, INC., Chiyoda-ku, Tokyo (JP)

(72) Inventors: Shunichi Takaya, Tokyo (JP); Hiroshi Morimoto, Tokyo (JP); Wataru Watanabe, Tokyo (JP); Kei Okamura, Kanagawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/056,036

(22) Filed: Feb. 29, 2016

(65) Prior Publication Data

US 2016/0266533 A1 Sep. 15, 2016

(30) Foreign Application Priority Data

Mar. 11, 2015 (JP) ..... 2015-048418

(51) Int. Cl.
*G03G 15/00* (2006.01)

(52) U.S. Cl.
CPC ..... *G03G 15/556* (2013.01); *G03G 15/5058* (2013.01)

(58) Field of Classification Search
CPC ..... G03G 15/5058; G03G 15/556
USPC ..... 399/49, 72
See application file for complete search history.

(56) References Cited

U.S. PATENT DOCUMENTS 9,170,541 B2 * 10/2015 Ikeda ..... G03G 15/5058
9,432,547 B2 * 8/2016 Furuta et al. ..... G03G 15/5058

FOREIGN PATENT DOCUMENTS

JP 2013-088717 A 5/2013

* cited by examiner

*Primary Examiner* — William J Royer
(74) *Attorney, Agent, or Firm* — Buchanan Ingersoll & Rooney PC

(57) ABSTRACT

An image forming apparatus uses a first developer conveyance amount and a first correction amount calculated respectively in a first state, a second developer conveyance amount and a second correction amount calculated respectively in a second state in which the developer conveyance amount is smaller than the developer conveyance amount of the first state, and a third developer conveyance amount detected in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

18 Claims, 8 Drawing Sheets

IMAGE FORMING APPARATUS, IMAGE FORMING SYSTEM, AND DENSITY UNEVENNESS CORRECTION METHOD

CROSS REFERENCE TO RELATED APPLICATIONS

This application is entitled to and claims the benefit of Japanese Patent Application No. 2015-048418, filed on Mar. 11, 2015, the disclosure of which including the specification, drawings and abstract is incorporated herein by reference in its entirety.

BACKGROUND OF THE INVENTION

1. Field of the Invention

The present invention relates to an image forming apparatus, an image forming system, and a density unevenness correction method.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet, and then heat and pressure are applied to the sheet at a fixing nip to form an image on the sheet.

In such an image forming apparatus, the image quality of an output image (image formed on a sheet) may be degraded due to degradation over time of a photoconductor drum, a developer, or the like, the environment around the apparatus (changes in temperature and humidity), or the like. Specifically, an output image may not be faithfully reproduced based on the color of an input image, or tints may differ between images in some situations. As such, in conventional image forming apparatuses, image stabilization control is performed in order to ensure color reproducibility and color stability.

Further, in an image forming apparatus, density unevenness in a circumferential direction (sub-scanning direction) may be caused in a toner image formed on a photoconductor drum due to distance variation between the photoconductor drum and the developing roller caused by rotational runout of a developing roller. In that case, density unevenness is caused also in an image formed on a sheet in synchronization with the rotational cycle of the developing roller. In the image stabilization control for preventing such cyclical density unevenness, density of a patch image (toner pattern) formed on a photoconductor drum is detected by an optical sensor, and density correction of an image is performed by performing image processing on an input image data based on the detection result, or changing image formation conditions such as charging potential, developing potential, and a light exposure amount. In general, image stabilization control is performed regularly using a non-image formation region when image formation is performed continuously on a plurality of sheets.

Japanese Patent Application Laid-Open No. 2013-88717 discloses a technique of performing more preferable correction by predicting the amplitude of banding (horizontal streaks caused by density difference) at the time of printing, and performing banding correction processing based on the predicted amplitude. The image forming apparatus disclosed in Japanese Patent Application Laid-Open No. 2013-88717 includes a developing roller configured to perform periodic movement for formation of an image, a table holding unit configured to hold a table for correcting density variation caused by electrical resistance of the developing roller, which is created in a reference state of the developing roller, a prediction unit configured to predict amplitude of variation in a state different from the reference state, and an adjustment unit configured to adjust the table based on the amplitude predicted by the prediction unit.

However, in a state immediately after turning on and activation of the image forming apparatus after the image forming apparatus has been stopped for a long time (hereinafter referred to as "post-stop state"), the amount (hereinafter referred to as "developer conveyance amount") of the developer conveyed on the developing roller is large and unstable due to decrease in the charge amount of the developer. The developer conveyance amount is decreased as the time passes from the post-stop state, but is stabilized at a certain level in a steady state after continuous printing. Consequently, in the post-stop state where the developer conveyance amount is large, the density unevenness in the sub-scanning direction and accordingly the density correction amount required for the density unevenness are increased in comparison with those in the steady state. FIG. 1 illustrates density of a patch image detected at corresponding rotational positions of the developing roller in the post-stop state and in the steady state. As shown in FIG. 1, an amplitude B of a waveform (dotted line in the figure) representing a density change of the patch image in the post-stop state is larger than an amplitude A of a waveform (solid line in the figure) showing a density change of the patch image in the steady state. Therefore, the density correction amount required for correcting the density of the toner image to be a target density in the post-stop state is larger than the density correction amount required for correcting the density of the toner image to be the target density in the steady state. As such, the correction amount may disadvantageously become excessive and density unevenness in the sub-scanning direction may not be corrected when the density correction is continued using the density correction amount calculated in the post-stop state as it is.

It should be noted that the technique described in Japanese Patent Application Laid-Open No. 2013-88717 is not a technique intended to control a transfer voltage which should be applied to a transfer member in accordance with changes in the image formation environment during the image formation processing regardless of the image formation conditions, and as such the technique does not include a configuration for that purpose.

SUMMARY OF THE INVENTION

An object of the present invention is to provide an image forming apparatus, an image forming system, and a density unevenness correction method which can correct density unevenness in a sub-scanning direction even if the developer conveyance amount varies.

To achieve the above-mentioned object, an image forming apparatus reflecting one aspect of the present invention includes: a rotatable image bearing member; a developer bearing member configured to bear a developer while rotating and form a toner image on a surface of the image bearing member by supplying toner contained in the developer to the image bearing member; a density detection section configured to detect density of the toner image formed on the surface of the image bearing member; a correction amount calculation section configured to calculate a correction amount for correcting density unevenness of the toner image caused in a sub-scanning direction that is a rotating direction of the developer bearing member based on a detection result of the density detection section; a correction section configured to correct the density unevenness based on the correction amount calculated by the correction amount calculation section; a conveyance amount calculation section configured to calculate an amount of the developer conveyed on the developer bearing member as a developer conveyance amount; and a control section configured to use a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

Desirably, in the image forming apparatus, the control section calculates the third correction amount in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

Desirably, in the image forming apparatus, the conveyance amount calculation section calculates the developer conveyance amount based on a charge amount of the developer.

Desirably, in the image forming apparatus, the second state is an initial state of the developer.

Desirably, in the image forming apparatus, the correction section corrects the density unevenness of the toner image by performing image processing on an input image data.

Desirably, in the image forming apparatus, the correction section corrects the density unevenness of the toner image by changing an image formation condition.

To achieve the above-mentioned object, an image forming system reflecting one aspect of the present invention has a plurality of units including an image forming apparatus, the system including: a rotatable image bearing member; a developer bearing member configured to bear a developer while rotating and form a toner image on a surface of the image bearing member by supplying toner contained in the developer to the image bearing member; a density detection section configured to detect density of the toner image formed on the surface of the image bearing member; a correction amount calculation section configured to calculate a correction amount for correcting density unevenness of the toner image caused in a sub-scanning direction that is a rotating direction of the developer bearing member based on a detection result of the density detection section; a correction section configured to correct the density unevenness based on the correction amount calculated by the correction amount calculation section; a conveyance amount calculation section configured to calculate an amount of the developer conveyed on the developer bearing member as a developer conveyance amount; and a control section configured to use a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

Desirably, in the image forming system, the control section calculates the third correction amount in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

Desirably, in the image forming system, the conveyance amount calculation section calculates the developer conveyance amount based on a charge amount of the developer.

Desirably, in the image forming system, the second state is an initial state of the developer.

Desirably, in the image forming system, the correction section corrects the density unevenness of the toner image by performing image processing on an input image data.

Desirably, in the image forming system, the correction section corrects the density unevenness of the toner image by changing an image formation condition.

To achieve the above-mentioned object, in a density unevenness correction method, an image forming apparatus includes: a rotatable image bearing member; a developer bearing member configured to bear a developer while rotating and form a toner image on a surface of the image bearing member by supplying toner contained in the developer to the image bearing member; a density detection section configured to detect density of the toner image formed on the surface of the image bearing member; a correction amount calculation section configured to calculate a correction amount for correcting density unevenness of the toner image caused in a sub-scanning direction that is a rotating direction of the developer bearing member based on a detection result of the density detection section; a correction section configured to correct the density unevenness based on the correction amount calculated by the correction amount calculation section; a conveyance amount calculation section configured to calculate an amount of the developer conveyed on the developer bearing member as a developer conveyance amount, the method including using a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

Desirably, in the method, the third correction amount is calculated in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

Desirably, in the method, the conveyance amount calculation section calculates the developer conveyance amount based on a charge amount of the developer.

Desirably, in the method, the second state is an initial state of the developer.

Desirably, in the method, the correction section corrects the density unevenness of the toner image by performing image processing on an input image data.

Desirably, in the method, the correction section corrects the density unevenness of the toner image by changing an image formation condition.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail based on the accompanying drawings.

Figure 2:
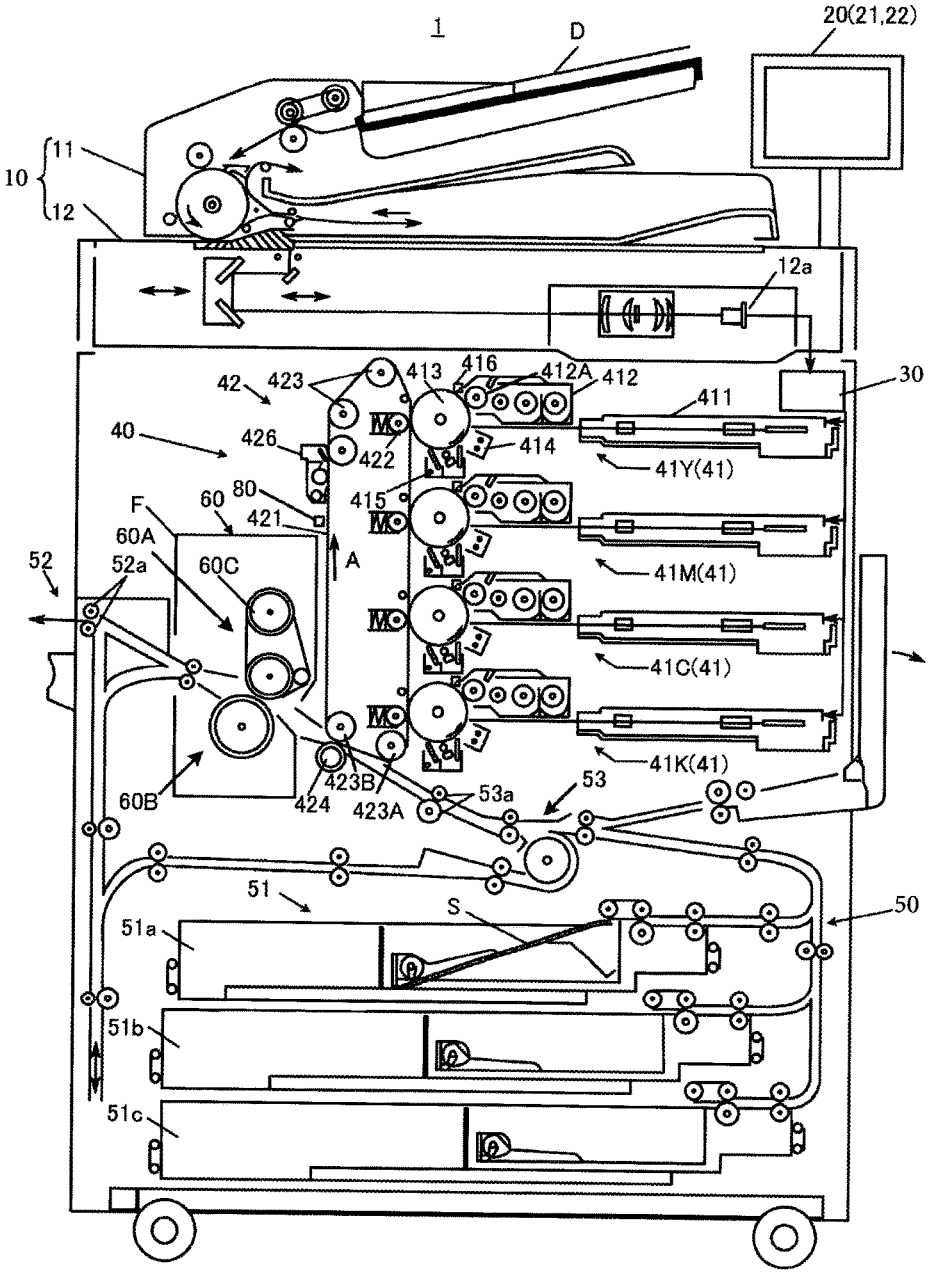
FIG. 2 schematically illustrates an overall configuration of an image forming apparatus according to an embodiment.
Figure 3:
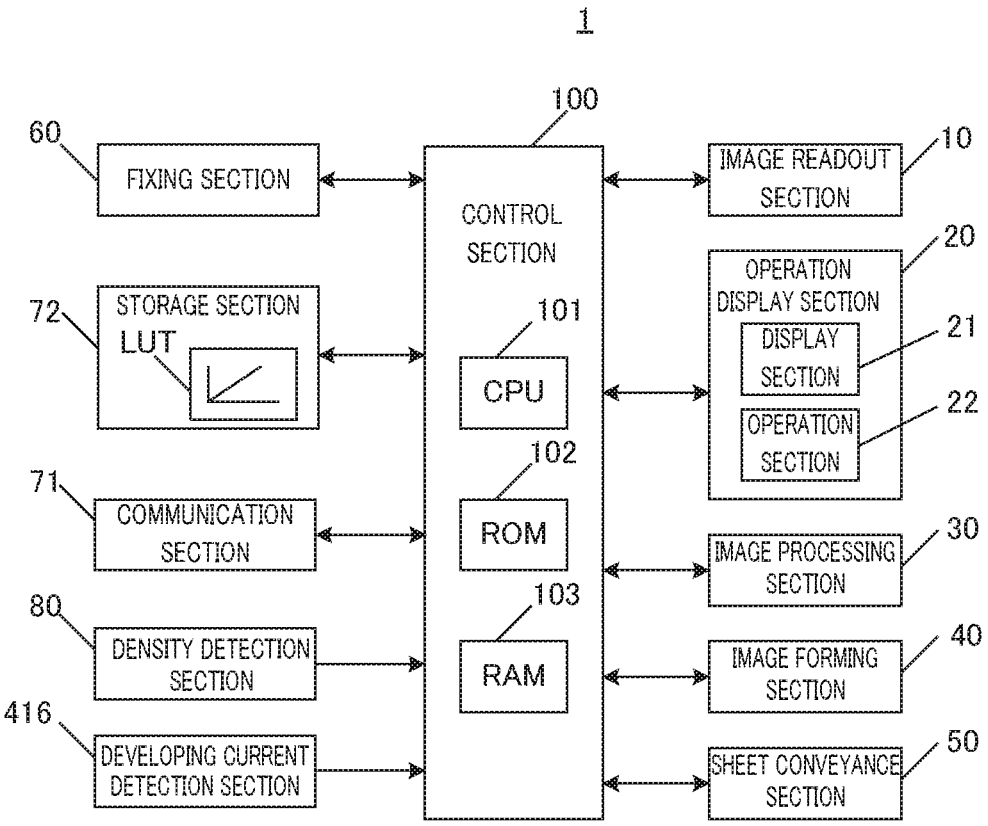
FIG. 3 illustrates main sections of a control system of the image forming apparatus according to the embodiment.

FIG. 2 schematically illustrates an overall configuration of image forming apparatus 1 according to an embodiment of the present invention. FIG. 3 illustrates main sections of a control system of image forming apparatus 1 according to the present embodiment. Image forming apparatus 1 illustrated in FIGS. 2 and 3 is an electrophotographic color image forming apparatus of an intermediate transfer system. Specifically, image forming apparatus 1 is configured to form an image by transferring (primarily transferring) respective color toner images of yellow (Y), magenta (M), cyan (C), black (K), formed on photoconductor drums 413, to intermediate transfer belt 421, and after superimposing the toner images of the four colors on intermediate transfer belt 421, transferring (secondarily transferring) the resultant image on sheet S. The processing speed of the image formation processing by image forming apparatus 1 is 315 mm/second, for example.

Image forming apparatus 1 adopts a tandem system in which the photoconductor drums 413 corresponding to the four colors of YMCK are arranged in series in a travel direction of intermediate transfer belt 421, whereby the toner images of the respective colors are sequentially transferred to intermediate transfer belt 421 in one procedure.

As shown in FIG. 3, image forming apparatus 1 includes image readout section 10, operation display section 20, image processing section 30, image forming section 40, sheet conveyance section 50, fixing section 60, and control section 100. Control section 100 functions as "correction amount calculation section," "correction section," "conveyance amount calculation section," and "control section" of the embodiment of the present invention.

Control section 100 includes central processing unit (CPU) 101, read only memory (ROM) 102, random access memory (RAM) 103, and the like. CPU 101 reads a program corresponding to the processing content from ROM 102 and develops it on RAM 103, and controls operation of the respective blocks of image forming apparatus 1 in a centralized manner, in cooperation with the developed program. At this time, various types of data stored in storage section 72 are referred to. Storage section 72 is composed of a non-volatile semiconductor memory (so-called flash memory) or a hard disk drive, for example.

Control section 100 transmits and receives various types of data with external devices (for example, personal computer) connected with a communication network such as a local area network (LAN) or a wide area network (WAN) via a communication section 71. For example, control section 100 receives image data transmitted from an external device, and forms an image on sheet S based on the image data (input image data). Communication section 71 is composed of a communication control card such as a LAN card.

Image readout section 10 includes an auto document feeder 11 which is called an ADF, document image scanner 12 (scanner), and the like.

Auto document feeder 11 conveys document D placed on a document tray by a conveyance mechanism to send the document to document image scanner 12. With auto document feeder 11, images (even both sides thereof) of a large number of documents D placed on the document tray can be successively read at once.

Document image scanner 12 optically scans a document D conveyed from auto document feeder 11 onto a contact glass or a document placed on the contact glass, forms an image by reflective light from the document D on a light receiving surface of charge coupled device (CCD) sensor 12*a*, and reads the document image. Image readout section 10 generates input image data based on the readout result by document image scanner 12. On the input image data, predetermined image processing is performed in image processing section 30.

Operation display section 20 is composed of a liquid crystal display (LCD) with a touch panel, for example, and functions as display section 21 and operation section 22. Display section 21 displays various operation screens, states of images, operating statuses of respective functions, and the like in accordance with display control signals input from control section 100. Operation section 22 includes various operation keys such as a numeric key pad and a start key. Operation section 22 accepts various input operations from a user, and outputs operation signals to control section 100.

Image processing section 30 includes a circuit configured to perform digital image processing corresponding to an initial setting or a user setting, and the like on the input image data. For example, image processing section 30 performs gradation correction based on tone correction data (tone correction table) under the control of control section 100. In addition to the tone correction, image processing section 30 performs various correction processes such as color correction and shading correction, a compression process, and the like on the input image data. Image forming section 40 is controlled based on the image data on which such processing has been performed.

Image forming section 40 includes image forming units 41Y, 41M, 41C, and 41K for forming an image by respective color toners of Y component, M component, C component, and K component on the basis of the input image data, an intermediate transfer unit 42, and the like.

Figure 1:
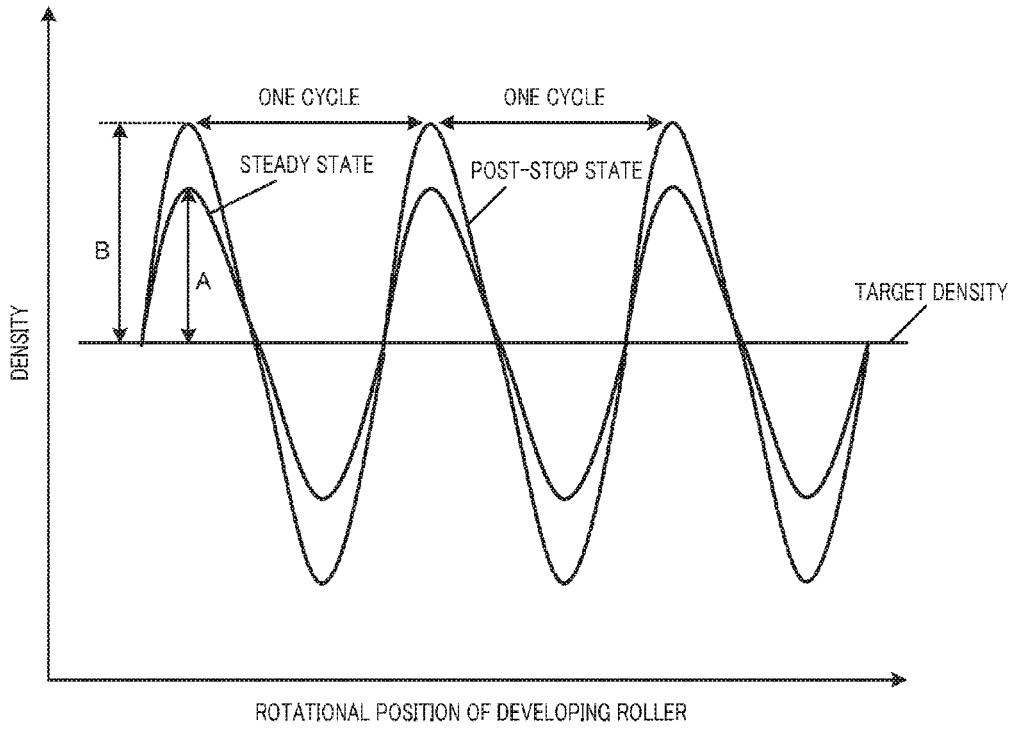
FIG. 1 illustrates density correction amounts required at respective rotational positions of a developing roller in a post-stop state and a steady state.

The image forming units 41Y, 41M, 41C, and 41K for the Y component, the M component, the C component, and the K component have the same configuration. For convenience of the drawings and the description, a common component is denoted by the same reference sign, and for distinction, it is denoted by adding Y, M, C, or K to the reference sign. In FIG. 1, only components of the image forming unit 41Y for the Y component are denoted by reference numerals, and as for components of other image forming units 41M, 41C, and 41K, reference numerals are omitted.

The image forming unit 41 includes exposing device 411, developing device 412, photoconductor drum 413 (which corresponds to an "image bearing member" of the embodiment of the present invention), charging device 414, drum cleaning device 415, and the like.

Photoconductor drum 413 is a negative electrification-type organic photo-conductor (OPC) in which an under coat layer (UCL), a charge generation layer (CGL), and a charge transport layer (CTL) are sequentially laminated on the peripheral surface of an aluminum conductive cylindrical body (aluminum-elementary tube) having a drum diameter of 60 mm. The charge generation layer is made of an organic semiconductor in which a charge generation material (phthalocyanine pigment, for example) is dispersed in a resin binder (polycarbonate, for example), and generates a pair of positive charge and negative charge through light exposure by exposing device 411. The charge transport layer is made of a layer in which a hole transport material (electron donating nitrogen compound) is dispersed in a resin binder (polycarbonate resin, for example), and transports positive charge generated in the charge generation layer to the surface of the charge transport layer.

Control section 100 controls a drive current supplied to a drive motor (not shown) which rotates photoconductor drum 413, whereby photoconductor drum 413 rotates at constant peripheral speed.

Charging device 414 generates corona discharging to uniformly charge the surface of photoconductor drum 413 having photoconductivity.

Exposing device 411 is composed of a semiconductor laser, for example, and irradiates a laser beam corresponding to an image of each color component to photoconductor drum 413. Positive charge is generated on the charge generation layer of photoconductor drum 413, which is transported to the surface of the charge transport layer, whereby the surface charge (negative charge) of photoconductor drum 413 is neutralized. On the surface of photoconductor drum 413, an electrostatic latent image of each color component is formed by the potential difference from its surroundings.

Developing device 412 is a developing device of a two-component reverse-rotation type. By applying toner (particle diameter: 6 μm) of each color component to the surface of photoconductor drum 413, the electrostatic latent image is visualized and a toner image is formed. Developing roller 412A (which corresponds to "developer bearing member" of the embodiment of the present invention) held by developing device 412 carries the developer while rotating, and supplies the toner contained in the developer to photoconductor drum 413, to form a toner image on the surface of photoconductor drum 413. The outer diameter of developing roller 412A is 25 mm. In the vicinity of developing roller 412A, developing current detection section 416 is provided. Developing current detection section 416 measures a current value flowing in developing roller 412A by application of a developing voltage during the developing operation. Developing current detection section 416 outputs the measured current value to control section 100.

Drum cleaning device 415 includes a drum cleaning blade which is brought into sliding contact with the surface of photoconductor drum 413, and removes residual transfer toner remaining on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426, and the like.

Intermediate transfer belt 421 is composed of an endless belt in which polyimide (PI) is used as a base material, and is stretched around support rollers 423 in a loop form. At least one of support rollers 423 is composed of a driving roller, and the others are each composed of a driven roller. For example, preferably, roller 423A arranged on the downstream side of primary transfer roller 422 for the K component in a belt travel direction is a driving roller 423A. Thereby, the travel speed of the belt in the primary transfer section can be kept constant easily. With rotation of driving roller 423A, intermediate transfer belt 421 travels at a constant speed in an arrow A direction.

In the present embodiment, density detection section 80 is provided at a position facing the outer peripheral surface of intermediate transfer belt 421. Density detection section 80 is formed on the surface of photoconductor drum 413, and detects the density of the toner image transferred to intermediate transfer belt 421. Density detection section 80 is used at the time of image stabilization control for faithfully reproducing the toner deposition amount (density) of an input image to an output image. Density detection section 80 detects the reflected light amount from a patch image (toner pattern) formed on the outer peripheral surface of intermediate transfer belt 421, and outputs the detected reflected light amount to control section 100. A patch image is formed by image forming section 40 with the rotation of intermediate transfer belt 421 such that the image faces density detection section 80.

As density detection section 80, an optical sensor including a light emitting element such as a light-emitting diode (LED) and a light receiving element such as a photo diode (PD) is applicable. Density detection section 80 irradiates the surface of intermediate transfer belt 421 with light, and detects the amount of light reflected therefrom (reflected light amount). The larger the toner deposition amount of the patch image formed on intermediate transfer belt 421, the larger the amount of the irradiated light which is blocked by the patch image, thus reducing the light receiving amount at the light receiving element and the reflected light amount, and, reducing a sensor output value output from density detection section 80. On the contrary, the smaller the toner deposition amount of the patch image formed on intermediate transfer belt 421, the greater the amount the light reflected at intermediate transfer belt 421, thus increasing the light receiving amount at the light receiving element, and, increasing a sensor output value output from density detection section 80.

Intermediate transfer belt 421 is a belt having electrical conductivity and elasticity, including, on the surface thereof, a high-resistivity layer whose volume resistivity is 8 to 11 log Ω·cm. Intermediate transfer belt 421 is rotationally driven by a control signal from control section 100. It should be noted that the material, thickness, and hardness of intermediate transfer belt 421 are not limited as long as intermediate transfer belt 421 has electrical conductivity and elasticity.

Primary transfer roller 422 is arranged on the inner peripheral surface side of intermediate transfer belt 421 such that primary transfer roller 422 faces photoconductor drum 413 of each color component. Primary transfer roller 422 is brought into pressure contact with photoconductor drum 413 with intermediate transfer belt 421 therebetween, whereby a primary transfer nip for transferring the toner image from photoconductor drum 413 to intermediate transfer belt 421 is formed.

Secondary transfer roller 424 is arranged on the outer peripheral surface side of intermediate transfer belt 421 such that secondary transfer roller 424 faces backup roller 423B arranged on the downstream side of driving roller 423A in a belt travel direction. Secondary transfer roller 424 is brought into pressure contact with backup roller 423B with intermediate transfer belt 421 therebetween, whereby a secondary transfer nip for transferring the toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. Specifically, a primary transfer bias is applied to primary transfer roller 422, and electric charge having a polarity opposite to that of the toner is applied to the rear side (the side in contact with primary transfer roller 422) of intermediate transfer belt 421, whereby the toner image is electrostatically transferred to intermediate transfer belt 421.

Then, when sheet S passes through the secondary transfer nip, the toner image on intermediate transfer belt 421 is secondarily transferred to sheet S. Specifically, a secondary transfer bias is applied to secondary transfer roller 424, and electric charge having a polarity opposite to that of the toner is applied to the rear side (the side in contact with secondary transfer roller 424) of sheet S, whereby the toner image is electrostatically transferred to sheet S. Sheet S on which the toner image is transferred is conveyed toward fixing section 60.

Belt cleaning device 426 removes the residual transfer toner remaining on the surface of intermediate transfer belt 421 after the secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes upper fixing section 60A having a fixing surface side member arranged on the fixing surface (surface on which the toner image is formed) side of sheet S, lower fixing section 60B having a rear surface side support member arranged on the rear surface (surface opposite to the fixing surface) side of sheet S, heating source 60C, and the like. The rear surface side support member is brought into pressure contact with the fixing surface side member, whereby a fixing nip for conveying sheet S in a sandwiching manner is formed.

At the fixing nip, fixing section 60 applies heat and pressure to sheet S on which a toner image has been secondary-transferred to fix the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance passage section 53, and the like. Three sheet feed tray units 51*a* to 51*c* included in sheet feeding section 51 store sheets S (standard sheets, special sheets) discriminated on the basis of the basis weight, the size, and the like, for each type set in advance. Conveyance passage section 53 includes a plurality of pairs of conveyance rollers such as a pair of registration rollers 53*a*.

Sheets S stored in sheet feed tray units 51*a* to 51*c* are output one by one from the uppermost, and conveyed to image forming section 40 by conveyance passage section 53. At this time, the registration roller section in which the pair of registration rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus 1 by sheet ejection section 52 including sheet ejection rollers 52*a*.

Image forming apparatus 1 may cause a problem that image quality of an output image (image formed on sheet S) deteriorates due to degradation of photoconductor drum 413, the developer, or the like with time, the environment around the image forming apparatus 1 (changes in temperature and humidity), or the like. Specifically, in some situations, an output image is not faithfully reproduced based on the color of an input image, and tints differ between images. In view of this, an image stabilization control is performed to ensure color reproducibility and color stability in image forming apparatus 1. The image stabilization control is performed at the time when image forming apparatus 1 is turned on and activated, at the time when printing of a predetermined number of sheets is performed, at the time when the variation amount in the surrounding environment (temperature, humidity, and the like) of the image forming apparatus 1 exceeds a predetermined range, at the time of recovery from a trouble such as failure, or the like.

In the image stabilization control, the density of the patch image formed on intermediate transfer belt 421 is detected by density detection section 80, and density correction of the image is performed by performing image processing on the input image data based on the detection result, or changing the image formation conditions such as charging potential, developing potential, and a light exposure amount.

Further, in image forming apparatus 1, density unevenness in a circumferential direction (sub-scanning direction) may be caused in the toner image formed on photoconductor drum 413 by distance variation between photoconductor drum 413 and developing roller 412A due to the rotation runout of developing roller 412A, for example. In that case, in the image formed on intermediate transfer belt 421 and accordingly, in the image formed on sheet S, density unevenness is caused in synchronization with the rotational cycle of developing roller 412A.

When such density unevenness in the sub-scanning direction is caused, control section 100 corrects the density unevenness based on the detection result (that is, a waveform representing density variation in the patch image) of density detection section 80 of the patch image formed on photoconductor drum 413 and on intermediate transfer belt 421. Control section 100 adjusts the density so as to increase the density of a portion having a density lower than a target density and reduce the density of a portion having a density higher than the target density. The density adjustment is performed by changing the setting value of the toner density in the input image data and the developing bias as an image formation condition.

Meanwhile, in a state where image forming apparatus 1 is turned on and activated after it has been stopped for a long time (post-stop state, which corresponds to "first state" of the embodiment of the present invention), the amount (developer conveyance amount) of the developer conveyed on developing roller 412A is large and unstable due to a drop in the charge amount of the developer. The developer conveyance amount decreases as time passes from the post-stop state, but is stabilized at a certain level in a steady state (which corresponds to "second state" of the embodiment of the present invention) such as a state after continuous printing. Consequently, in the post-stop state where the developer conveyance amount is large, density unevenness in the sub-scanning direction is increased and consequently a density correction amount required for the density unevenness is increased in comparison with the steady state. As such, if the density correction is continued using the density correction amount calculated in the post-stop state, the correction amount becomes excessive, making it impossible to correct the density unevenness in the sub-scanning direction.

In view of the above, in the present embodiment, on the basis of the fact that there is a proportional relationship (linear relationship) between the developer conveyance amount and a density correction amount required for the density unevenness in the sub-scanning direction during the time from the post-stop state to the steady state, the developer conveyance amount is calculated at all times and control is performed as described below. Specifically, control section 100 stores the developer conveyance amount and the density correction amount in the steady state and the developer conveyance amount and the density correction amount in the post-stop state where the developer conveyance amount is excess in storage section 72 in advance, and calculates the developer conveyance amount at each time point (transition state, which corresponds to "third state" of the embodiment of the present invention) up to the steady state. On the basis of the calculated developer conveyance amount, and the developer conveyance amount and the density correction amount stored in storage section 72, control section 100 calculates the density correction amount for correcting the density unevenness in the sub-scanning direction. Thus, at each time point from the post-stop state until establishment of the steady state, it is possible to prevent the correction amount from becoming excessive and to correct density unevenness in the sub-scanning direction.

Figure 4:
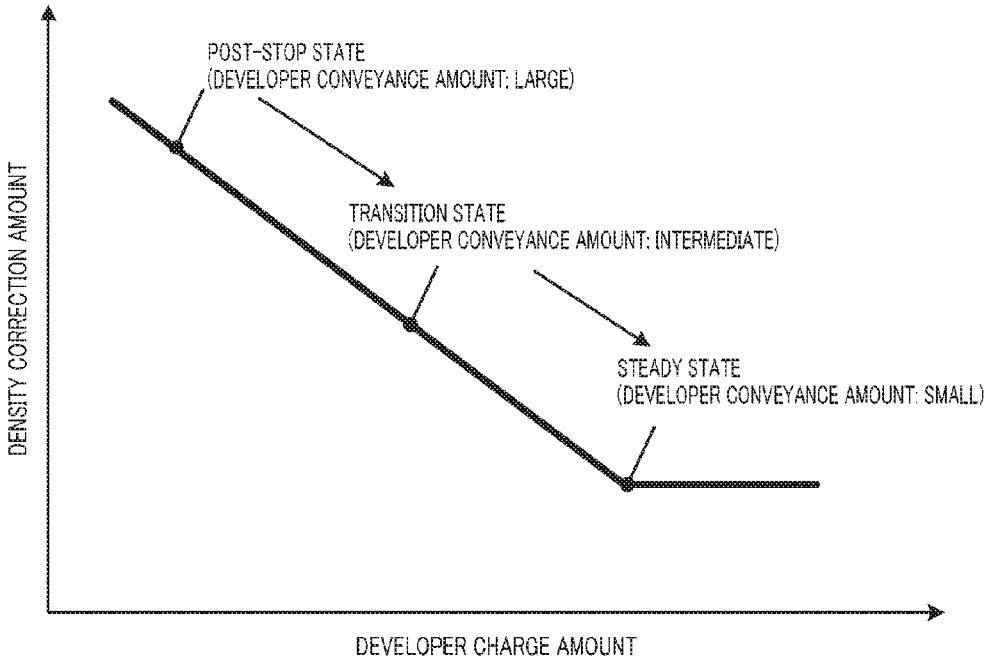
FIG. 4 illustrates a relationship between a developer charge amount and a density correction amount.

FIG. 4 illustrates relationships between the charge amount and the density correction amount in the post-stop state, the transition state, and the steady state. As shown in FIG. 4, in the post-stop state, the charge amount of the developer is small and the developer conveyance amount is large, and therefore the density correction amount is large. On the contrary, in the steady state, the charge amount of the developer is large and the developer conveyance amount is small, and therefore the density correction amount is small. Each of the charge amount of the developer, the developer conveyance amount, and the density correction amount in the transition state is an intermediate amount between those of the post-stop state and the steady state. Between the charge amount of the developer and the developer conveyance amount, there is a proportional relationship that the developer conveyance amount decreases as the charge amount thereof increases. As such, during the time from the post-stop state to the steady state, there is a proportional relationship between the developer conveyance amount and the density correction amount required for the density unevenness in the sub-scanning direction.

Figure 5:
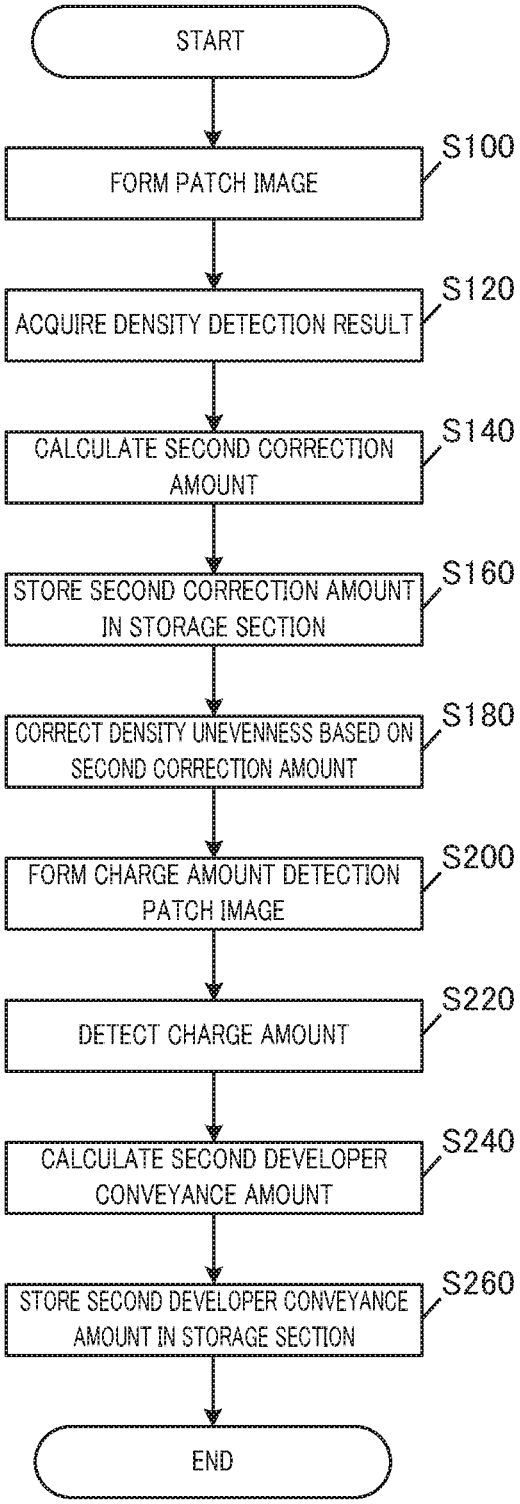
FIG. 5 is a flowchart showing a density correction operation of the image forming apparatus in a steady state.

Next, a density correction operation of image forming apparatus 1 according to the present embodiment will be described. First, with reference to the flowchart of FIG. 5, description will be given on an operation of calculating the developer conveyance amount and the density correction amount in the steady state, when an execution instruction of a detection mode is received via operation section 22, or the like. The steady state is a state where the charge amount of the developer in developing device 412 is large and the developer conveyance amount is stable at a constant level. The steady state is established at the time after continuous printing, at the time of initial installment of the developer (developer initial state), and the like.

First, control section 100 controls image forming section 40 to form a patch image having an intermediate gradation level (200 gradation level in the present embodiment) or higher on photoconductor drum 413 and on the outer peripheral surface of intermediate transfer belt 421 (step S100). Specifically, on the outer peripheral surface of the photoconductor drum 413, image forming section 40 forms a patch image of a toner band having a size of 10 mm in a main scanning direction×44 mm (which corresponds to the outer periphery of developing roller 412A) in a sub-scanning direction and 10 cycles.

Next, control section 100 acquires a detection result of density detection section 80 of the patch image formed on the outer peripheral surface on intermediate transfer belt 421 (step S120). The detection result is a waveform representing a density change in the patch image corresponding to the rotational position of developing roller 412A. Image forming apparatus 1 includes a rotational position detection section (not shown) configured to detect a rotational position of developing roller 412A when the patch image is formed on the outer peripheral surface of the photoconductor drum 413. Control section 100 can detect density unevenness in the sub-scanning direction corresponding to the rotational position of developing roller 412A by comparing the detection result obtained by the rotational position detection section with the detection result obtained by density detection section 80.

Figure 8:
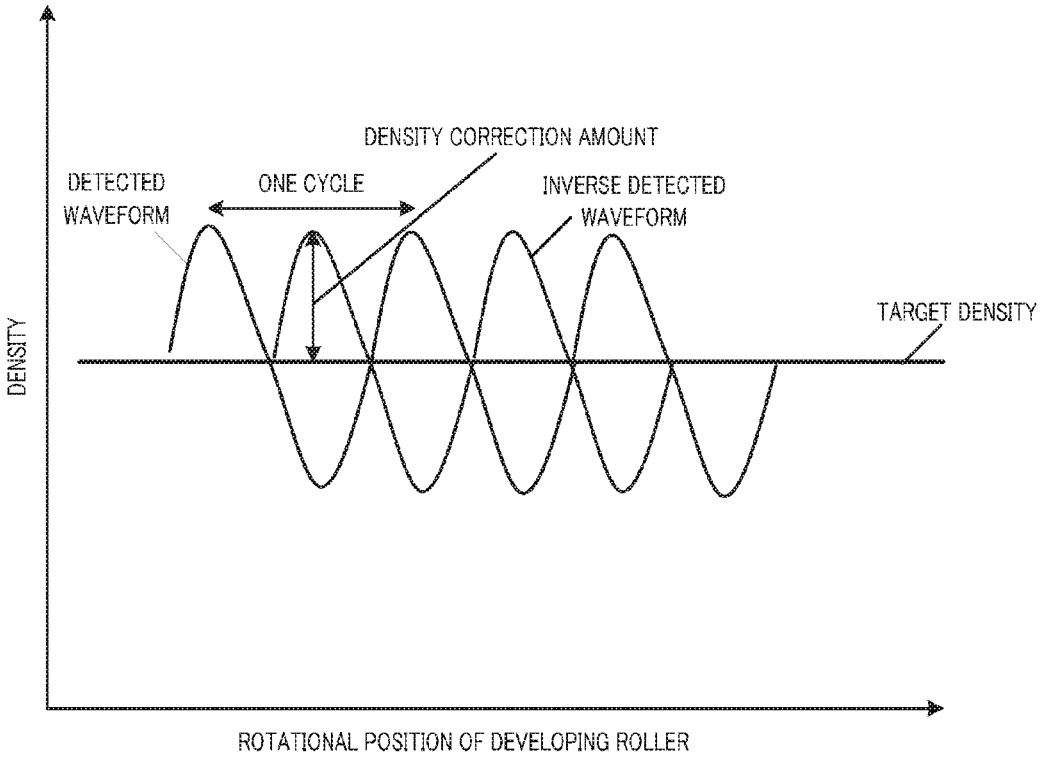
FIG. 8 illustrates a detected waveform and an inverse detected waveform.

Next, based on the acquired detection result (detected waveform), control section 100 calculates a density correction amount (hereinafter referred to as "second correction amount") required for the density unevenness in the sub-scanning direction (step S140). Specifically, control section 100 applies fast Fourier transform processing on the detected waveform, and after segmenting a frequency band to be corrected for the purpose of removing noise, performs inverse fast Fourier transform to obtain an inverse detected waveform. FIG. 8 illustrates a detected waveform (solid line) and an inverse detected waveform (dotted line). The inverse detected waveform is a waveform representing a change in the density correction amount corresponding to the rotational position of developing roller 412A. As shown in FIG. 8, by feeding back a density waveform of a phase opposite to that of cyclical density unevenness to the input image data corresponding to each rotational position of developing roller 412A, the image density can be kept constant.

Next, control section 100 stores the calculated second correction amount in storage section 72 (step S160). Then, control section 100 corrects the density unevenness of the sub-scanning direction by performing image processing on the input image data based on the calculated second correction amount, or changing the image formation conditions such as charging potential, developing potential, and a light exposure amount (step S180).

Next, control section 100 controls image forming section 40 to form a charge amount detection patch image for detecting a charge amount of the developer on the outer peripheral surface of photoconductor drum 413 (step S200). Then, based on the electrical current value measurement result of developing current detection section 416 when the charge amount detection patch image is formed, and on the detection result of density detection section 80 of the charge amount detection patch image formed on intermediate transfer belt 421, control section 100 detects the charge amount of the developer (step S220).

Next, based on the detected charge amount, control section 100 calculates a developer conveyance amount (hereinafter referred to as "second developer conveyance amount") (step S240). In the present embodiment, control section 100 refers to a predetermined table showing a correspondence relationship (proportional relationship) between the charge amount of the developer and the developer conveyance amount to calculate the developer conveyance amount corresponding to the detected charge amount as the second developer conveyance amount.

Finally, control section 100 stores the detected second developer conveyance amount in storage section 72 (step S260). Upon completion of the processing at step S260, image forming apparatus 1 ends the processing shown in FIG. 5.

Figure 6:
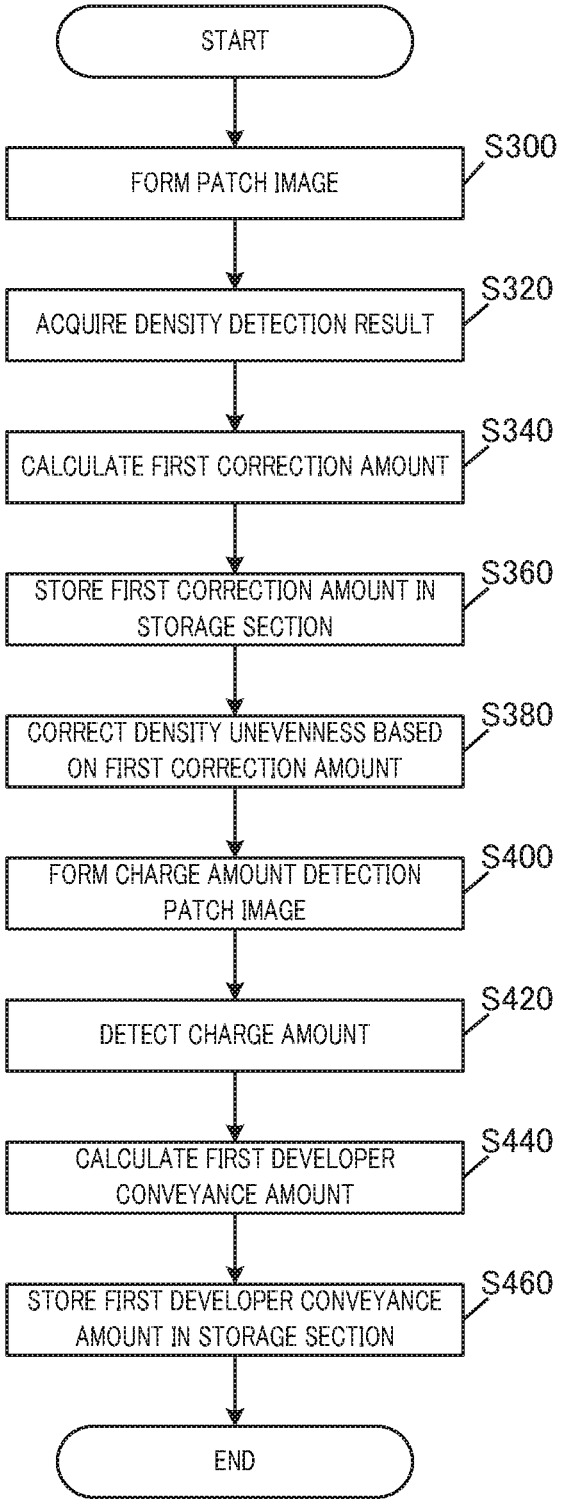
FIG. 6 is a flowchart showing a density correction operation of the image forming apparatus in a post-stop state.

Next, with reference to FIG. 6, an operation of calculating the developer conveyance amount and the density correction amount in the post-stop state will be described, as with the calculation operation in the steady state. The post-stop state is a state where the developer conveyance amount is large and unstable due to a small charge amount of the developer in developing device 412.

First, control section 100 controls image forming section 40 to form a patch image on photoconductor drum 413 and on the outer peripheral surface of intermediate transfer belt 421 (step S300). Specifically, on the outer peripheral surface of the photoconductor drum 413, image forming section 40 forms a patch image of a toner band having a size of 10 mm in a main scanning direction, 44 mm (which corresponds to the outer periphery of developing roller 412A) in a sub-scanning direction, and 10 cycles.

Next, control section 100 acquires a detection result of density detection section 80 of the patch image formed on the outer peripheral surface of intermediate transfer belt 421 (step S320). Then, based on the acquired detection result (detected waveform), control section 100 calculates a density correction amount (hereinafter referred to as "first correction amount") required for the density unevenness in the sub-scanning direction (step S340).

Next, control section 100 stores the calculated first correction amount in storage section 72 (step S360). Then, control section 100 corrects the density unevenness in the sub-scanning direction by performing image processing on the input image data based on the calculated first correction amount, changing the image formation conditions such as charging potential, developing potential, and a light exposure amount, or the like (step S380).

Next, control section 100 controls image forming section 40 to form a charge amount detection patch image for detecting the charge amount of the developer on the outer peripheral surface of photoconductor drum 413 (step S400). Then, control section 100 detects the charge amount of the developer based on the electric current value measurement result by developing current detection section 416 when the charge amount detection patch image is formed, and on the detection result of density detection section 80 of the charge amount detection patch image formed on intermediate transfer belt 421 (step S420).

Next, control section 100 calculates a developer conveyance amount (hereinafter referred to as "first developer conveyance amount") based on the detected charge amount (step S440). Finally, control section 100 stores the calculated first developer conveyance amount in storage section 72 (step S460). Upon completion of the processing of step S460, image forming apparatus 1 ends the processing shown in FIG. 6.

Figure 7:
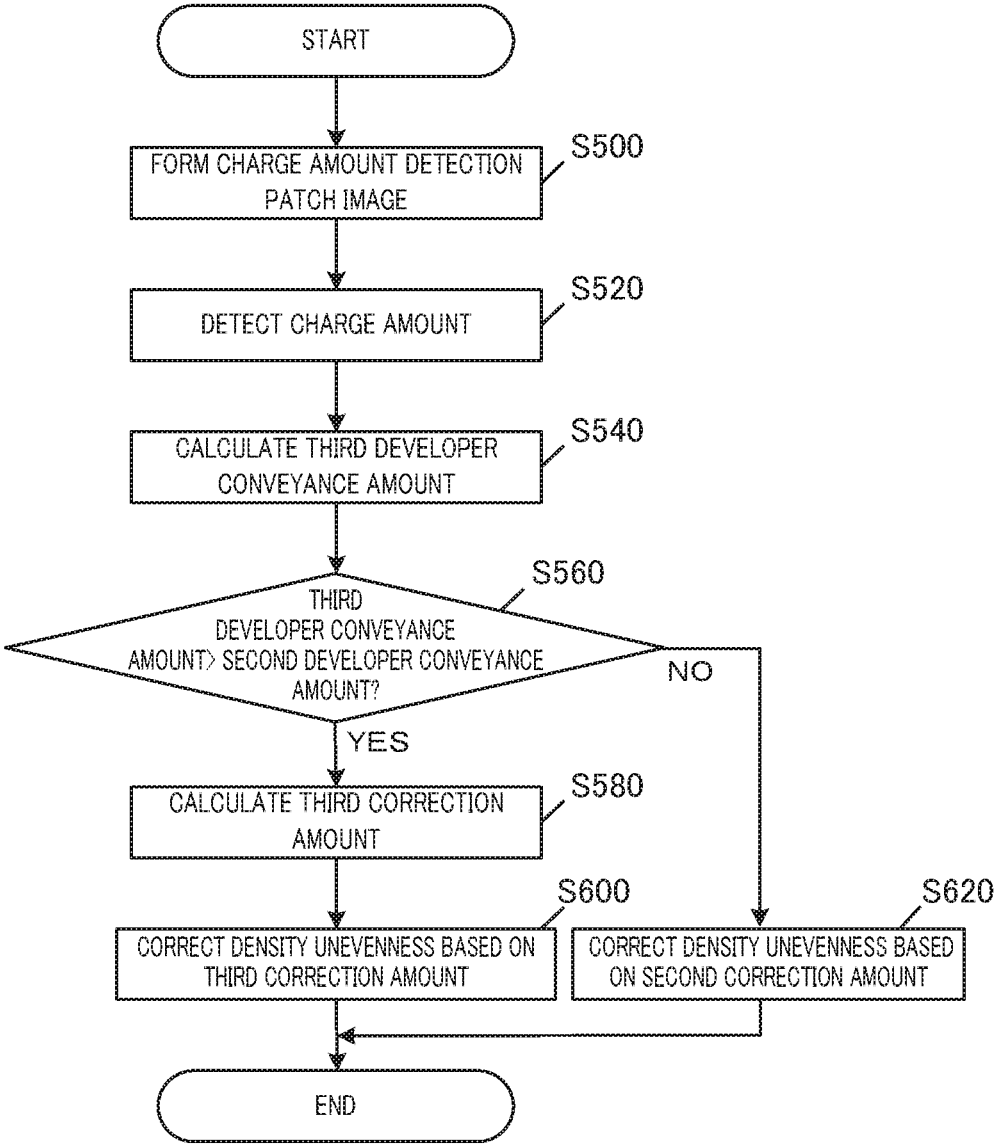
FIG. 7 is a flowchart showing a density correction operation of the image forming apparatus in a transition state.

Finally, with reference to FIG. 7, an operation of calculating the developer conveyance amount and the density correction amount in the transition state (each time point up to the steady state) will be described. The post-stop state is a state where the developer conveyance amount is large and unstable because of a small charge amount of the developer in developing device 412 in comparison with the steady state.

First, control section 100 controls image forming section 40 to form a charge amount detection patch image for detecting the charge amount of the developer on the outer peripheral surface of photoconductor drum 413 (step S500). Then, control section 100 detects the charge amount of the developer based on the electrical current value measurement result of developing current detection section 416 when the charge amount detection patch image is formed, and on the detection result of density detection section 80 of the charge amount detection patch image formed on intermediate transfer belt 421 (step S520).

Next, control section 100 calculates a developer conveyance amount (hereinafter referred to as "third developer conveyance amount") based on the detected charge amount (step S540). Then, control section 100 determines whether or not the calculated third developer conveyance amount is larger than the second developer conveyance amount stored in storage section 72 (step S560). As a result of determination, if the third developer conveyance amount is not larger than the second developer conveyance amount, that is, if it is considered that the state has been shifted to the steady state (step S560, NO), control section 100 corrects the density unevenness in the sub-scanning direction by performing image processing on the input image data based on the second correction amount stored in storage section 72, or changing the image formation conditions such as charging potential, developing potential, and a light exposure amount, or the like (step S620). Upon completion of the processing of step S620, image forming apparatus 1 ends the processing shown in FIG. 7.

On the other hand, if the third developer conveyance amount is larger than the second developer conveyance amount, that is, if it is considered that the state has not been shifted to the steady state (step S560, YES), control section 100 calculates a density correction amount (hereinafter referred to as "third correction amount") required for the density unevenness in the sub-scanning direction in accordance with the following Expression (1) (step S580):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

Finally, control section 100 corrects the density unevenness in the sub-scanning direction by performing image processing on the input image data based on the calculated third correction amount, or changing the image formation conditions such as charging potential, developing potential, and a light exposure amount, or the like (step S600). Upon completion of the processing of step S600, image forming apparatus 1 ends the processing shown in FIG. 7.

As described above in detail, in the present embodiment, image forming apparatus 1 uses the first developer conveyance amount and the first correction amount calculated by the conveyance amount calculation section and the correction amount calculation section in the post-stop state, the second developer conveyance amount and the second correction amount calculated by the conveyance amount calculation section and the correction amount calculation section in the steady state in which the developer conveyance amount is smaller than that in the post-stop state, and the third developer conveyance amount calculated by the conveyance amount calculation section in the transition state in which the developer conveyance amount is smaller than that in the post-stop state and is larger than that in the steady state to calculate the third correction amount for correcting the density unevenness of the toner image in the transition state, and perform control to correct the density unevenness of the toner image based on the calculated third correction amount.

According to the present embodiment having the above-mentioned configuration, at each time point from the post-stop state until establishment of the steady state, it is possible to prevent the correction amount from becoming excessive and to correct the density unevenness in the sub-scanning direction. Further, in the present embodiment, after calculating the third developer conveyance amount, the third correction amount is calculated by the expression using the third developer conveyance amount. As such, it is possible to calculate the third correction amount without performing multiple processes including formation of a patch image, detection of the density of the patch image, and application of fast Fourier transform to the density detection result.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims. The present invention is applicable to an image forming system composed of a plurality of units including an image forming apparatus. The units include a post-processing device, an external device such as a control device or the like connected with a network, for example.

Example

Finally, description will be given on the result of experiment for confirming effectiveness in the above-described embodiment performed by the present inventors.

[Configuration of Image Forming Apparatus According to Example]

As an image forming apparatus according to an example, image forming apparatus 1 having the configuration shown in FIGS. 2 and 3 was used.

[Configuration of Image Forming Apparatus According to Comparative Example]

As an image forming apparatus according to a comparative example, image forming apparatus 1 having the configuration shown in FIGS. 2 and 3 was used. However, unlike the above-described embodiment, an operation of correcting the density unevenness in the sub-scanning direction was performed by using a density correction amount calculated in the post-stop state as it was.

[Experimental Method]

In the experiment, from a state immediately after turning on and activation of the image forming apparatus after the image forming apparatus had been stopped for sixteen hours (post-stop state), image formation processing of a black (K) halftone image having the image density of 128 gradation value was continuously performed on 1000 sheets. Then, the degree of density unevenness in the sub-scanning direction was checked. In this experiment, "the degree of density unevenness in the sub-scanning direction" in the example and the comparative example was evaluated based on the following criteria.

(The degree of density unevenness in the sub-scanning direction)

Good: No density unevenness was found

Fair: Minor density unevenness which does not cause practical problem was found

Poor: Serious density unevenness which causes practical problem was found

Table 1 shows the degree of density unevenness in the sub-scanning direction in the example and the comparative example respectively.

TABLE 1

| | Degree of density unevenness | | | |
|---|---|---|---|---|
| | 0 sheet | 100 sheets | 500 sheets | 1000 sheets |
| Example | Good | Good | Good | Good |
| Comparative example | Good | Fair | Poor | Poor |

[Experimental Result]

As shown in Table 1, in the example, it was possible to prevent occurrence of an excessive correction amount and to correct density unevenness in the sub-scanning direction even after the image formation processing on 1000 sheets from the post-stop state. On the other hand, in the comparative example, the correction amount became excessive after the image formation processing on 100 sheets from the post-stop state, and then the degree of density unevenness in the sub-scanning direction was further deteriorated after the image formation processing on 500 sheets. From the experiment result described above, effectiveness in the embodiment described above was confirmed.

What is claimed is:

1. An image forming apparatus comprising:

a rotatable image bearing member;

a developer bearing member configured to bear a developer while rotating and form a toner image on a surface of the image bearing member by supplying toner contained in the developer to the image bearing member;

a density detection section configured to detect density of the toner image formed on the surface of the image bearing member;

a correction amount calculation section configured to calculate a correction amount for correcting density unevenness of the toner image caused in a sub-scanning direction that is a rotating direction of the developer bearing member based on a detection result of the density detection section;

a correction section configured to correct the density unevenness based on the correction amount calculated by the correction amount calculation section;

a conveyance amount calculation section configured to calculate an amount of the developer conveyed on the developer bearing member as a developer conveyance amount; and a control section configured to use a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

2. The image forming apparatus according to claim 1, wherein the control section calculates the third correction amount in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

3. The image forming apparatus according to claim 1, wherein the conveyance amount calculation section calculates the developer conveyance amount based on a charge amount of the developer.

4. The image forming apparatus according to claim 1, wherein the second state is an initial state of the developer.

5. The image forming apparatus according to claim 1, wherein the correction section corrects the density unevenness of the toner image by performing image processing on an input image data.

6. The image forming apparatus according to claim 1, wherein the correction section corrects the density unevenness of the toner image by changing an image formation condition.

7. An image forming system having a plurality of units including an image forming apparatus, the system comprising:

a rotatable image bearing member;

a developer bearing member configured to bear a developer while rotating and form a toner image on a surface of the image bearing member by supplying toner contained in the developer to the image bearing member;

a density detection section configured to detect density of the toner image formed on the surface of the image bearing member;

a correction amount calculation section configured to calculate a correction amount for correcting density unevenness of the toner image caused in a sub-scanning direction that is a rotating direction of the developer bearing member based on a detection result of the density detection section;

a correction section configured to correct the density unevenness based on the correction amount calculated by the correction amount calculation section;

a conveyance amount calculation section configured to calculate an amount of the developer conveyed on the developer bearing member as a developer conveyance amount; and a control section configured to use a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

8. The image forming system according to claim 7, wherein the control section calculates the third correction amount in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

9. The image forming system according to claim 7, wherein the conveyance amount calculation section calculates the developer conveyance amount based on a charge amount of the developer.

10. The image forming system according to claim 7, wherein the second state is an initial state of the developer.

11. The image forming system according to claim 7, wherein the correction section corrects the density unevenness of the toner image by performing image processing on an input image data.

12. The image forming system according to claim 7, wherein the correction section corrects the density unevenness of the toner image by changing an image formation condition.

13. A density unevenness correction method in an image forming apparatus including:

a rotatable image bearing member;

a developer bearing member configured to bear a developer while rotating and form a toner image on a surface of the image bearing member by supplying toner contained in the developer to the image bearing member;

a density detection section configured to detect density of the toner image formed on the surface of the image bearing member;

a correction amount calculation section configured to calculate a correction amount for correcting density unevenness of the toner image caused in a sub-scanning direction that is a rotating direction of the developer bearing member based on a detection result of the density detection section;

a correction section configured to correct the density unevenness based on the correction amount calculated by the correction amount calculation section; and a conveyance amount calculation section configured to calculate an amount of the developer conveyed on the developer bearing member as a developer conveyance amount, the method comprising using a first developer conveyance amount and a first correction amount calculated by the conveyance amount calculation section and the correction amount calculation section respectively in a first state, a second developer conveyance amount and a second correction amount calculated by the conveyance amount calculation section and the correction amount calculation section respectively in a second state in which the developer conveyance amount is smaller than the developer conveyance amount of the first state, and a third developer conveyance amount detected by the conveyance amount calculation section in a third state in which the developer conveyance amount is smaller than the developer conveyance amount of the first state and is larger than the developer conveyance amount of the second state to calculate a third correction amount for correcting density unevenness of the toner image in the third state, and perform control to correct the density unevenness of the toner image based on the calculated third correction amount.

14. The density unevenness correction method according to claim 13, wherein the third correction amount is calculated in accordance with a following expression (1):

$$Y=(E-C)/(E-D)\times(P-X) \quad (1)$$

where E represents the first developer conveyance amount, P represents the first correction amount, D represents the second developer conveyance amount, X represents the second correction amount, C represents the third developer conveyance amount, and Y represents the third correction amount.

15. The density unevenness correction method according to claim 13, wherein the conveyance amount calculation section calculates the developer conveyance amount based on a charge amount of the developer.

16. The density unevenness correction method according to claim 13, wherein the second state is an initial state of the developer.

17. The density unevenness correction method according to claim 13, wherein the correction section corrects the density unevenness of the toner image by performing image processing on an input image data.

18. The density unevenness correction method according to claim 13, wherein the correction section corrects the density unevenness of the toner image by changing an image formation condition.

* * * * *